US009599328B2

(12) United States Patent
Koplow

(10) Patent No.: US 9,599,328 B2
(45) Date of Patent: Mar. 21, 2017

(54) SOLID STATE LIGHTING DEVICES AND METHODS WITH ROTARY COOLING STRUCTURES

(75) Inventor: Jeffrey P. Koplow, San Ramon, CA (US)

(73) Assignee: Sandia Corporation, Albuquerque, NM (US)

( * ) Notice: Subject to any disclaimer, the term of this patent is extended or adjusted under 35 U.S.C. 154(b) by 1115 days.

(21) Appl. No.: 13/409,982

(22) Filed: Mar. 1, 2012

(65) Prior Publication Data

US 2012/0223640 A1 Sep. 6, 2012

Related U.S. Application Data

(60) Provisional application No. 61/448,655, filed on Mar. 2, 2011.

(51) Int. Cl.

| | |
|---|---|
| ***F21V 29/00*** | (2015.01) |
| ***F21V 29/74*** | (2015.01) |
| ***F21V 29/63*** | (2015.01) |
| ***F04D 17/16*** | (2006.01) |
| ***F04D 29/58*** | (2006.01) |
| ***F21V 29/02*** | (2006.01) |
| *F28F 3/02* | (2006.01) |
| *F21Y 101/00* | (2016.01) |

(52) U.S. Cl.

CPC ..... *F21V 29/74* (2015.01); *F04D 17/16* (2013.01); *F04D 29/582* (2013.01); *F21V 29/02* (2013.01); *F21V 29/63* (2015.01); *F21Y 2101/00* (2013.01); *F28F 3/02* (2013.01); *F28F 2250/08* (2013.01)

(58) Field of Classification Search

CPC ..... F21V 29/83; F21V 29/70; F21V 29/507; F21V 29/763; F21V 29/773; F21V 29/02; F21V 29/74; F21V 29/677; F21V 23/023; F21V 29/002; F21V 29/006; F21V 29/60; F21V 29/67; F21V 29/673; F21V 29/20

USPC ..... 362/373

See application file for complete search history.

(56) References Cited

U.S. PATENT DOCUMENTS

| | | | | |
|---|---|---|---|---|
| 4,538,214 A * | 8/1985 | Fisher | F21V 21/096 | 362/147 |
| 6,367,949 B1 * | 4/2002 | Pederson | B60Q 1/2611 | 362/240 |
| 7,161,256 B2 * | 1/2007 | Fang | H02K 7/1807 | 362/812 |
| 8,092,054 B2 * | 1/2012 | Liu | F21K 9/00 | 362/294 |

(Continued)

*Primary Examiner* — William Carter

(74) *Attorney, Agent, or Firm* — Dorsey & Whitney, LLP

(57) ABSTRACT

Solid state lighting devices and methods for heat dissipation with rotary cooling structures are described. An example solid state lighting device includes a solid state light source, a rotating heat transfer structure in thermal contact with the solid state light source, and a mounting assembly having a stationary portion. The mounting assembly may be rotatably coupled to the heat transfer structure such that at least a portion of the mounting assembly remains stationary while the heat transfer structure is rotating. Examples of methods for dissipating heat from electrical devices, such as solid state lighting sources are also described. Heat dissipation methods may include providing electrical power to a solid state light source mounted to and in thermal contact with a heat transfer structure, and rotating the heat transfer structure through a surrounding medium.

23 Claims, 4 Drawing Sheets

(56) References Cited

U.S. PATENT DOCUMENTS

| | | | | |
|---|---|---|---|---|
| 2006/0262545 | A1* | 11/2006 | Piepgras | F21K 9/00 362/373 |
| 2010/0181889 | A1* | 7/2010 | Falicoff | F21K 9/00 313/46 |
| 2011/0075417 | A1* | 3/2011 | Lai | F21V 29/004 362/235 |
| 2012/0106140 | A1* | 5/2012 | Sun | F21K 9/135 362/158 |

* cited by examiner

SOLID STATE LIGHTING DEVICES AND METHODS WITH ROTARY COOLING STRUCTURES

CROSS-REFERENCE TO RELATED APPLICATION(S)

This application claims the benefit of the earlier filing date of provisional application No. 61/448,655, filed Mar. 2, 2011 entitled "Rotary Cooled Solid State Lighting," which application is hereby incorporated by reference in its entirety, for any purpose.

STATEMENT REGARDING RESEARCH & DEVELOPMENT

The United States Government has a paid-up license in this technology and the right in limited circumstances to require the patent owner to license others on reasonable terms as provided for by the terms of contract No. DE-AC04-94AL85000 awarded by the U.S. Department of Energy to Sandia Corporation.

TECHNICAL FIELD

Examples described herein relate to solid state lighting devices, methods and systems, and more specifically examples describe rotary-cooled solid state lighting devices.

BACKGROUND OF THE INVENTION

Solid state lighting devices have been used to provide energy savings in lighting power consumption due to the increased efficiency of their source. However, solid state lighting devices known in the art may be expensive and may have insufficient operational life to offset their higher costs.

In most commercially available LED bulbs, approximately 75-85% of the electrical power delivered to the bulb may be immediately converted to heat. This heat may limit the operational life of the device. For example, the insulating dielectric typically used in the electrolytic capacitors of LED driver and rectification/regulation circuitry may desiccate rapidly with exposure to the thermal cycles that currently available LED bulbs undergo. Capacitor mortality thus may be a significant problem in existing LED bulb technology.

One example of a currently available LED bulb for residential/commercial use would be the EcoSmart Model ECS38 LED bulb 100 (see FIG. 1), which can consume 18 W of electrical power and can provide a light output of 850 lumens, which is about the equivalent of a 60 W incandescent bulb. The bulb 100 utilizes passive fins, e.g. fin 112 to dissipate heat generated by the light source 120. The total internal power dissipation of the ECS38 bulb may be about 16 W, which can result in a package temperature rise of 23° C. above ambient (measured at the coolest point on the finned aluminum heat sink, which may be at the perimeter 114 of the heat sink which is farthest away from the heat source), corresponding to a heat sink thermal resistance of 1.4° C./W.

Furthermore, blue LEDs are typically used in most residential/commercial lighting applications, in which case the blue light emitted is first converted to white light. However, this conversion process may impose further inefficiencies in currently available LED bulbs.

BRIEF DESCRIPTION OF THE DRAWINGS

The accompanying drawings, which are incorporated into and form a part of the specification, illustrate one or more embodiments of the present application and, together with the description, serve to explain the principles of various embodiments. The drawings are only for the purpose of illustrating various embodiments, and are not to be construed as limiting. In the drawings.

DETAILED DESCRIPTION OF PREFERRED EMBODIMENTS

Figure 1:
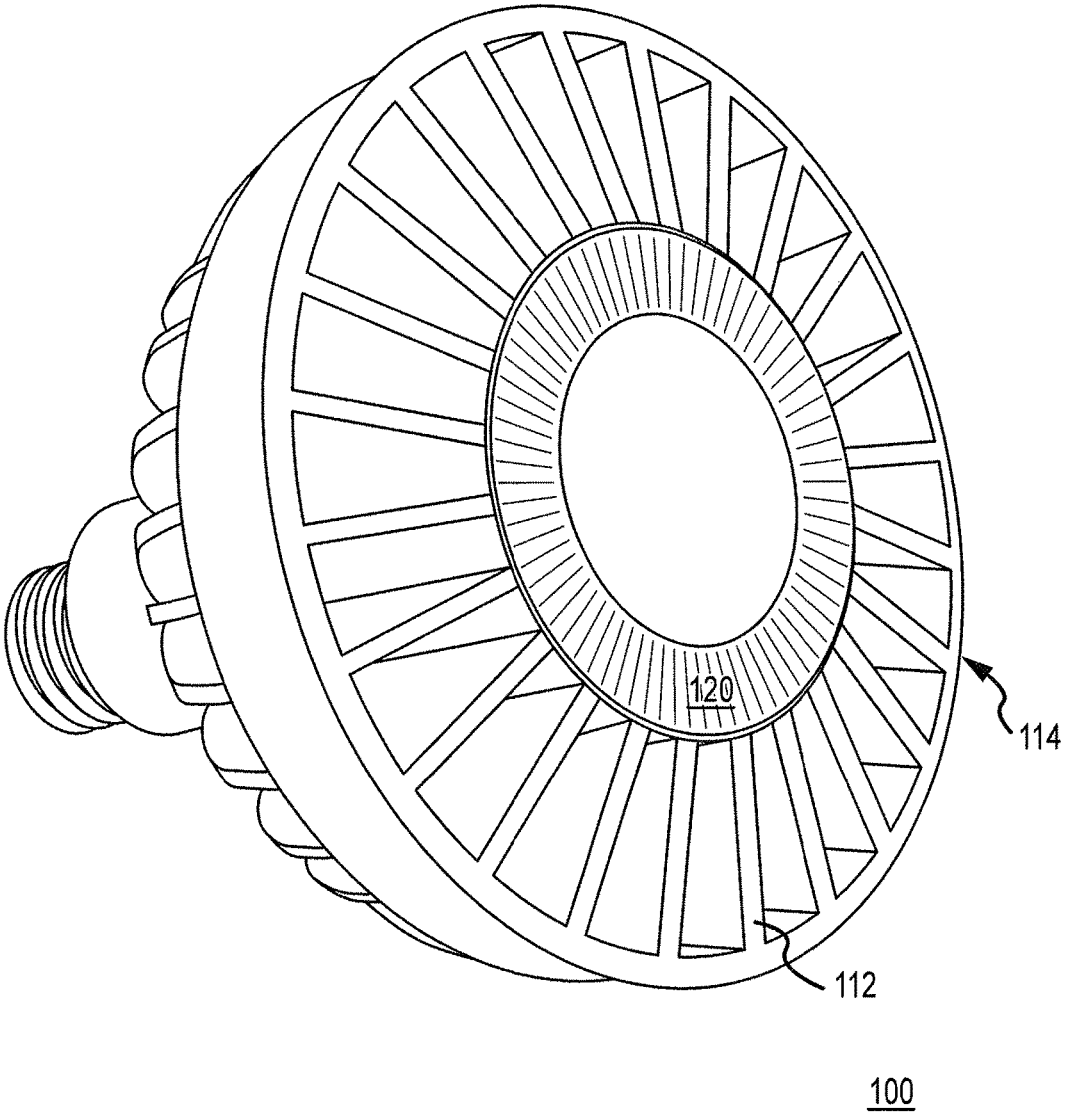
FIGURE 1 (PRIOR ART)
FIG. 1 illustrates an example of a currently available LED bulb.

Certain details are set forth below to provide a sufficient understanding of embodiments of the invention. However, it will be clear to one skilled in the art that embodiments of the invention may be practiced without various of these particular details. In some instances, well-known circuits, structures, materials, and control signals have not been shown in detail in order to avoid unnecessarily obscuring the described embodiments of the invention.

Widespread adoption of solid state lighting (SSL) technology may eventually reduce the U.S. aggregate electrical power consumption for lighting (e.g. including residential, commercial, and industrial uses) by at least a factor of two. Although capable of providing much lower electrical power consumption than conventional incandescent and fluorescent lighting, solid state lighting has achieved less than 1% market penetration. One reason, as mentioned above, may be due to the difficulties in providing a device and packaging that can deliver sufficient thermal management and thus provide sufficient lifespan to offset the costs of production. Other reasons may include other inefficiencies that exist in currently available light emitting diode (LED) bulbs. Examples described herein may address some of the existing problems with solid state lighting devices.

In the following detailed description, reference is made to the accompanying drawings which form a part hereof and in which are shown, by way of illustration, specific embodiments and the manner in which they may be practiced. These embodiments are described in sufficient detail to enable those skilled in the art to practice such embodiments, and it is to be understood that other embodiments may be utilized and that structural changes may be made without departing from the spirit and scope of the embodiments described herein. Therefore, the following detailed description is not to be taken in a limiting sense, and the scope of this application is defined by appended claims.

Embodiments of lighting devices according to the present invention may generally include a solid state light source in thermal contact with a heat transfer structure, and a mounting assembly rotatably coupled to the heat transfer structure. The heat transfer structure may rotate through a surrounding medium, which may aid in dissipating heat generated by the solid state light source. Moreover, circuitry used to drive the solid state light source may also be placed in thermal contact with the heat transfer structure, and motion of the heat transfer structure may further aid in dissipating heat generated by the circuitry.

The solid state light source used may be any suitable semiconductor light source, or combination of light sources, and any number of individual sources may be used, including but not limited to one or a plurality of light-emitting diodes (LEDs), organic light-emitting diodes (OLEDs), polymer light-emitting diodes (PLEDs), light-emitting electrochemical cells (LECs or LEECs), or diode lasers. As would be apparent to those skilled in the art, any light-emitting semiconductor device may be adopted to function as the solid state light source in embodiments of the invention without departing from the scope and spirit of the examples described herein. As can be appreciated by those skilled in the art, embodiments described herein may be applied to thermal management of any light source and/or its associated drive circuitry, components, etc. For example, thermal management of plasma lighting (e.g. comprising an electrodeless discharge excited by a radio frequency or microwave frequency oscillator) is an example application of embodiments described herein to other lighting sources whether or not they may be considered solid state or semiconductor.

In some embodiments, the solid state light source may be implemented as a plurality of LEDs accompanied by driver circuitry, which may be provided on a printed circuit board (PCB). The PCB including the LEDs and circuitry may be in thermal contact with the heat transfer structure. In some embodiments, the LEDs and circuitry may be directly mounted to a surface of the heat transfer structure. As such, low thermal resistance for transferring heat from the LEDs and circuitry may be achieved. In some embodiments, a heat pipe or other heat spreader device may be provided between the LEDs and circuitry, and the heat transfer structure. As is known in the art, heat spreader devices may have high thermal conductivity, thus further efficiencies in heat transfer between the LEDs and circuitry (e.g. the thermal load) and the heat transfer structure may be achieved.

The light sources and/or PCB may be placed in thermal contact with the heat transfer structure by utilizing any combination of mounting techniques selected to optimize heat transfer between the light sources and/or PBC and the heat transfer structure. For example, the PCB may be directly mounted to the heat transfer structure (or to a heat spreader) by methods known in the art, including, but not limited to, gluing, bonding, soldering, or using other mechanical fastening methods known in the art. Thermally conductive adhesives may be used to glue the PCB to the heat transfer structure. Examples of thermally conductive adhesives include silicone, acrylics, or conductive epoxies, which may be available in a number of application formats, such as liquid, paste or tape format. The light sources and/or PCB may be mounted to the heat transfer structure via solder joints or via other mechanical fastening methods know in the art. For example, the light sources and/or PCB can be mounted to the heat transfer structure using NanoBond® technology (also known in the art as NanoFoil®), to facilitate the creation of blind solder joints while minimizing the potential for thermal damage to the components or surfaces being soldered together. In some embodiments, thermally conductive pads or greases may be used in conjunction with another adhesive material or a mechanical fastening method. As those skilled in the art would appreciate, many other commercially available technologies for mounting electrical components and circuitry may be used without departing from the spirit and scope of the present invention.

In some embodiments, the heat transfer structure may be implemented as a finned heat sink configured to rotate through a surrounding medium when the device is in operation. As would be appreciated by those skilled in the art, the precise form factor for the finned heat sink is a matter of choice and various configurations may be implemented. For the purposes of illustration, example form factors are described in further detail below, but other examples of form factors configured to rotate through a surrounding medium may be utilized. As those skilled in the art would appreciate, in embodiments in which various components such as LEDs, circuitry, or other, are mounted directly to the heat transfer structure, these components would also rotate through the surrounding medium while the device is operational. By rotating the heat transfer structure to which electrical components (e.g. thermal load) are mounted to, heat may be more efficiently dissipated.

The mounting assembly may have a stationary portion configured to remain stationary during operation of the device. The stationary portion may be a base configured to be fitted in a conventional light socket. The stationary portion may be coupled to the rotating heat transfer structure via a rotary joint, which would allow the heat transfer structure and thermal load attached to the heat transfer structure to rotate and cool during operation, while the base of the device remains stationary.

Figure 2:
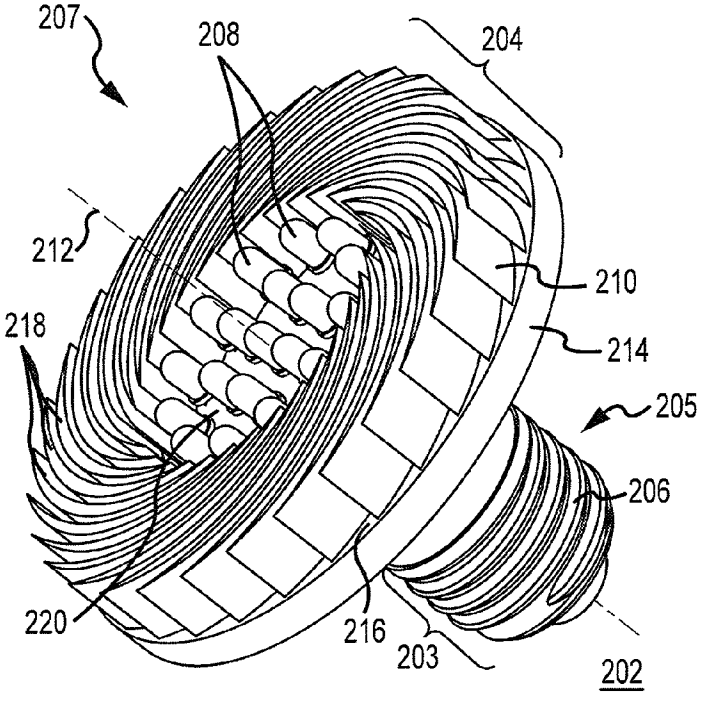
FIG. 2 is a schematic illustration of a bottom isometric view of a solid state lighting device according to an embodiment of the present invention.

FIG. 2 is a schematic illustration of a bottom isometric view of a solid state lighting device according to an embodiment of the present invention. The lighting device 202 may include a heat transfer structure 204, a plurality of light-emitting diodes (LEDs) 208 coupled to an LED driver circuit (not shown), and a mounting assembly 203, which may include a base 206. Suitable heat transfer structures that may be used as the heat transfer structure 204 are also described as air-cooled heat exchangers and described in U.S. Publication No. 2009/0199997, which is incorporated herein by reference in its entirety for any purpose. As discussed above, during operation, the heat transfer structure 204 and various components mounted to the heat transfer structure comprise the rotating portion 207 of the device. Components that remain stationary during operation, such as the base 206 and components rigidly mounted to the base (for example, one of the transformer cores, which is described in further detail below), comprise the stationary portion 205 of the device.

As depicted in FIG. 2, the heat transfer structure may be implemented as a rotating heat sink impeller 210, which may have a top plate 214 and a plurality of fins 218 attached to the top plate. However, as would be appreciated by those skilled in the art, other form factors may be used that are suitably shaped and configured to transfer waste heat from the LEDs and any circuitry to the surrounding medium. The surrounding medium may typically be air, but devices may find use in other environments where the medium may be different. The heat sink impeller 210 in the embodiment depicted in FIG. 2 may be configured to rotate about an axis of rotation 212. The heat sink impeller 210 may be made of a thermally conductive material, such as metal. The fins 218 and top plate 214 may be manufactured as a monolithic structure (e.g. they may be formed as a single piece of structure), which may be achieved by single-stroke cold forging, for example.

The top plate 214 of heat sink impeller 210 may have a bottom surface 216 to which the plurality of fins 218 may be attached. The top plate 214 may have a circular shape and the fins 218 may be arranged radially about the axis of rotation 212. The fins 218 may be arranged about the axis 212 to form an inlet region 220 at the center of the top plate, which does not include fins.

As would be appreciated by those skilled in the art, arranging the fins of the heat sink impeller 210 in the configuration depicted promotes radial flow of the surrounding medium, which may for example be air. That is, during operation of the device, when the heat sink impeller 210 is rotating, air flows into the heat sink impeller through inlet region 220 and is expelled radially and outwardly around the circumference of the device. As air circulates through the device, waste heat generated by the thermal load (in FIG. 2, the thermal load includes LEDs 208 and circuitry) is dissipated to the surrounding medium. Thus, while a specific configuration for the heat sink impeller 210 is depicted, the fins may be shaped and pitched in any manner suitable for generating radial flow as the heat sink impeller 210 is rotated. The fins may be sized and arranged in any configuration elected to provide optimal dissipation of heat from the solid state light source, e.g. LEDs and circuitry, to the surrounding medium. Furthermore, the heat transfer structure may be scaled up or down to accommodate various thermal loads, or in this example various lighting applications.

In some embodiments, the LEDs 208 and/or driver circuitry may be positioned in the inlet region 220 of the heat sink impeller 210, as depicted in FIG. 2. Mounting components in the inlet region may provide desirable cooling due to air flowing into the inlet by virtue of the aerodynamic characteristics of the heat sink impeller 210. In some embodiments, the top plate 214 may have a greater diameter than the effective diameter of the heat sink impeller 210, thus the edge of the top plate 214 may extend beyond the perimeter of the fins 218. In such embodiments, LEDs and circuitry may be placed along the annular shaped region outside of the perimeter of the fins.

Figure 3:
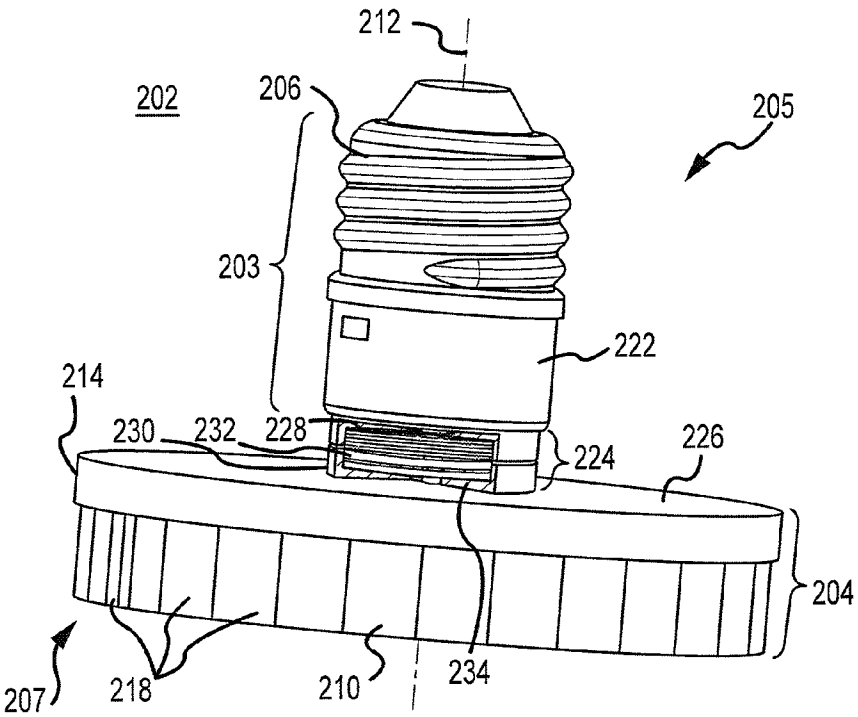
FIG. 3 is a schematic illustration of another view of a solid state lighting device according to an embodiment of the present invention.

FIG. 3 is a schematic illustration of a top isometric view of the solid state lighting device depicted in FIG. 2. As previously described, the lighting device 202 may have a rotating portion 207, which may include a heat transfer structure 204 and a solid state light source (not shown here), and a stationary portion 205, which may include a base 206. The stationary portion 205 and rotating portion 203 are rotatably coupled through a rotary joint. By rotary joint, it is meant herein a connection between components that allows the rotating portion 207 to rotate during operation, while some components remain stationary (e.g. the stationary portion 205 of the device). A rotary joint can be implemented by structural components known in the art, for example by using bearings to provide freedom of rotation, and/or a shaft to align the stationary and rotating components. Other examples may be utilized and an example of a rotary joint in an embodiment of the present invention is further described below.

The lighting device 202 may also include a motor 222 and a transformer 224, as well as rectifier circuitry (not shown) for converting ac current to dc current. The transformer 224 may be a split-core step-down transformer, which may have a primary core 228 positioned in the stationary portion 205 of the mounting assembly 203, and a secondary core 230 coupled to the rotating portion of the device (e.g. the heat transfer structure 204). In this example, the primary core 228 may be mounted to the motor 222, and the secondary core 230 may be mounted to the top plate 214 of the heat transfer structure 204. As would be appreciated by those skilled in the art, other placement of components, including the location of the motor, may be used.

An air gap 232 may remain between the primary and secondary cores, such that the primary core 228 and secondary core 230 may be free to rotate with respect to each other. Those skilled in the art would appreciate that the air gap 232 and rotation of the cores 228 and 230 would not cause interference with the magnetic flux. The air gap may further improve the B-H curve linearity for the magnetic circuit as a whole (e.g., for the purpose of minimizing any 50/60 Hz harmonic pollution of single-phase and three-phase power distribution networks).

The stationary and rotary components of the transformer 224 may be coupled together via a shaft 234 aligned with the axis of rotation 212. The shaft 234 may be the motor's shaft which can serve to align the various components coaxially as well as drive the rotation of the heat sink impeller 210 through the surrounding medium. In this manner, the transformer 224 may form part of the rotary joint between the stationary portion 205 of and the rotating portion 207 of the device. As previously mentioned, by rotary joint, herein is meant a coupling of components which allows the heat transfer structure 204 and LEDs mounted to the heat transfer structure to rotate during operation, while the base 206 remains stationary.

The motor 222 may drive the shaft 234 configured to rotate the heat transfer structure about the axis of rotation 212. The motor 222 may be an ac motor, which may be mounted in the stationary portion 205 of the mounting assembly 203. For example, the motor 222 may be a 1-watt ac motor or other motor having similarly negligible power consumption. The shaft 234 can be disposed along the axis of rotation 212 coupling the motor to the heat transfer structure to allow the motor to drive the rotation of the heat transfer structure 204 about the axis of rotation 212. As such, the shaft may serve to both align the components coaxially and transmit the rotational force generated by the motor 232 to the heat transfer structure 204.

Figure 4:
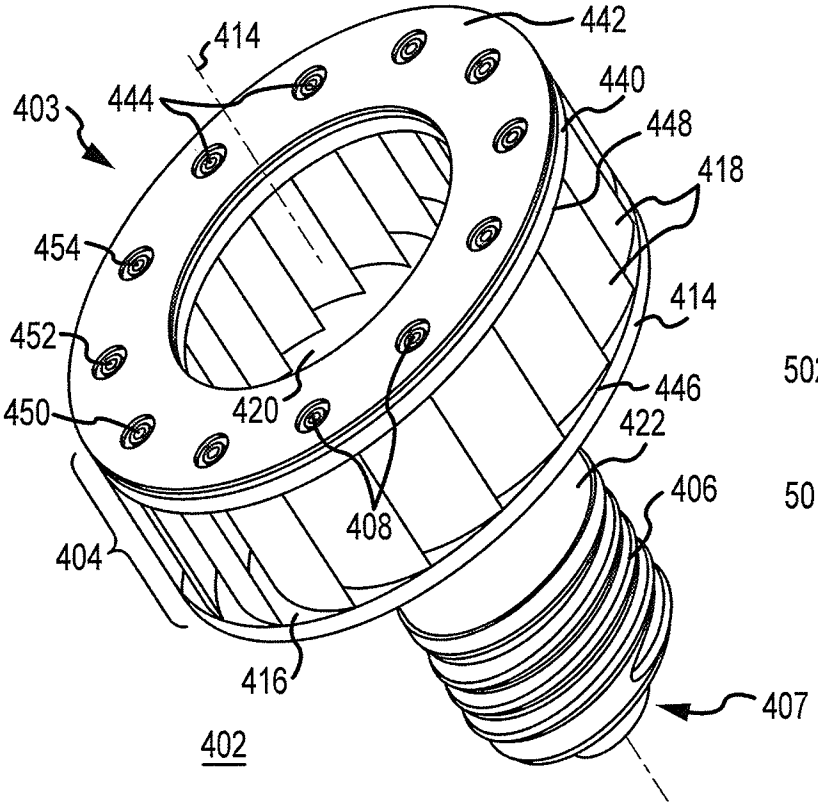
FIG. 4 is a schematic illustration of a bottom isometric view of a solid state lighting device according to another embodiment of the present invention.

An ac synchronous motor connected directly to the transformer secondary can be used to implement the motor 222, as depicted in FIGS. 2-4. In other embodiments, the motor may be a brushless dc motor. In further embodiments, the AC voltage or current waveform of the transformer secondary may be used to control the frequency and/or phase of the waveforms generated by the brushless dc motor controller, thereby allowing such a brushless dc motor to provide the same functionality of a synchronous ac motor. In some embodiments, what would normally be considered the stator of the brushless motor may be located in the rotating portion 207 of the device, and what would normally be considered the rotor of the brushless motor may remain stationary by coupling it to the base 206. As stator coils may tend to run warm, placing the stator in the rotating portion 207 of the device may offer the advantage of additional cooling. Of course, the opposite arrangement can also be used, with the rotor being located in the rotating portion 207, and the stator remaining in the stationary portion 205. In some embodiments the motor, or parts of the motor, may be positioned in the inlet region 220 of the heat transfer structure 204. Those skilled in the art would appreciate that placing the various electrical components, which in turn generate heat (e.g. thermal loads), within the rotating portion of the device, may provide improved thermal management for the device and its components. While specific arrangements of components have been described for illustration, the skilled artisan would appreciate that other configurations and arrangements of the transformer 234 and motor 222 may be implemented without departing from the scope and spirit of the invention.

FIG. 4 is a schematic illustration of a bottom isometric view of a solid state lighting device according to another embodiment of the present invention. The lighting device 420 may have a heat transfer structure 404, a base 406, and a solid state light source, which may be a plurality of LEDs 408. The LEDs may be mounted to the fins 418 of the heat transfer structure 404. As previously discussed, some embodiments may have a heat spreader 440. The heat spreader 440 may be a solid plate made of a conductive material, such as metal. The heat spreader 440 may have an annular shape, and may be positioned at and mounted to the bottom end of the fins 418. That is, when assembled, the plurality of fins 418 are enclosed between the top plate 414 and the heat spreader 440 with the inlet region 420 and the periphery of the fin assembly remaining open to the surrounding medium, as depicted in FIG. 4.

As previously discussed the fins 418 and top plate 414 may be manufactured as one integral unit (e.g. a monolithic structure), or they may be manufactured as separate components to be assembled to form the heat transfer structure 404 (e.g. a device in which the top plate 414 is fabricated from copper, and the fins are fabricated from thermally conductive plastic). The top plate 414 and fins may be manufactured as a monolithic structure by known methods in the art for molding or forming metals, including but not limited to single-stroke cold forging.

In embodiments having a heat spreader 440, low thermal resistance between the heat spreader 440 and the fins 418 of the heat transfer structure 404 may be achieved by methods known in the art. For example, the heat transfer structure 404 may be fabricated as a two-piece metal assembly. The circular array of fins 418 attached to top plate 414, both of which may be made of aluminum for example, may be fabricated as single, monolithic structures as previously described. The annular-shaped heat spreader 440 may also be made of aluminum and may be stamped from sheet metal and subsequently jointed to the monolithic finned assembly in a single operation using a multi-position spot welding fixture, for example. In other embodiments, as mentioned above, a heat pipe may be used and may be joined to the finned assembly by known methods in the art. This and other methods known in the art may be utilized to achieve low thermal resistance between the thermal load generated by LEDs 408 and circuitry and the heat transfer structure 404.

In the example of FIG. 4, the LEDs 408 may be arranged in a radial pattern about the axis of rotation 412. Although only a single circular array of LEDs in pattern 444 is depicted in FIG. 4, it would be appreciated that any number and configuration of arrays may be used (e.g. LEDs may span two, three, or more along the radial direction, and may be arranged regularly or randomly about the axis 412). It would be appreciated by those skilled in the art, that the exact arrangements of LEDs 408 in the figures is illustrative only and that the LEDs 408 may be positioned in any combination of locations elected to provide sufficient lighting. In some embodiments, LEDs and/or circuitry may be located in the inlet region 420 as previously discussed with reference to FIG. 2, in addition to LEDs positioned at the perimeter. Furthermore, the LEDs may also be mounted to various surfaces of the heat transfer structure (or additional structure may be adopted) to provide varied directionality of light output, if desired.

In some examples, LEDs and circuitry which are rigidly mounted to the rotating heat transfer structure, may rotate with the heat transfer structure during operation of the device. Thus, referring to FIG. 4 the LEDs 408 in a radial pattern about axis 412 may rotate with the heat transfer structure forming a circle of light. The LEDs may be white LEDs, or they may be colored LEDs. If colored LEDs are used, red, green, and blue LEDs may be arranged in an alternating circular array, for example, such that the rotation of the heat sink impeller 410 may facilitate a rotational spatial averaging of the colored LEDs to produce color mixing and generate white light. Accordingly, LED 450 may be a red LED, LED 452 may be a green LED, and LED 454 may be a blue LED. Any number of red, green, or blue LEDs may be combined on a surface of the heat spreader 440. As the heat transfer structure 404 rotates, it may rotate sufficiently fast that the colors are perceived as combining into white light, or another color of light generally determined by the arrangement of red, green, or blue LEDs used. Thus, by mounting the LEDs to a rotating frame, the additional benefit of dispensing with the color conversion process may be obtained. It would further be appreciated that fewer than or greater than three LED colors may be used in some applications, and that LED colors other than red, green and blue may be used, including but not limited to white, yellow, orange, amber, blue-green, and violet. More generally, each LED 408 may have any desirable wavelength distribution of emitted light, and each LED 408 may comprise one or multiple emitters. As described earlier, the color conversion process when using blue LEDs to output white light may impose a substantial efficiency penalty. By dispensing with the need to output white light from each individual LED emitter (e.g. as in the case of producing white light by color mixing through the described spatial averaging), the inefficiencies of converting blue light to white light may be avoided. Alternatively, a mixture of white and colored LEDs may be used to achieve a desired output wavelength distribution.

In some examples, if desired, closed-loop control of color balance may also be implemented. For example, closed-loop control of color balance may be achieved by using one or more sensors and control circuitry to vary the distribution of current to the different colored LEDs. Such closed-loop color-balance control may be desirable in outdoor applications, for example, where ambient temperature may vary considerably, thereby affecting the relative luminous efficiency of the different colored emitters.

As depicted in the example of lighting device 402 in FIG. 4, the LEDs may be mounted to the heat transfer structure. The LEDs may be mounted such that that they rotate with the heat transfer structure as in the case where the LEDs are mounted directly to the fins or to a heat spreader rigidly mounted to the fins. In other configurations, the LEDs may be mounted such that they remain stationary while the heat transfer structure is rotating, or they may be configured in any combination of the two, depending on placement and method of attaching the LEDs to the structure.

In some embodiments, the LEDs and circuitry may be mounted on any surface parallel to surface 416. For example, as previously described, the LEDs and circuitry, which may be provided on a circular PCB, may be mounted directly to the bottom surface of the fins 418. In other examples, a heat spreader 440 may be provided. The heat spreader 440 may be a plate made of a thermally conductive material, such as a metal and may have an annular shape, as previously described. The LEDs and circuitry may be mounted to a surface 442 of the heat spreader 440, with the LEDs forming a radial pattern 444. As previously discussed, pattern 444 is only exemplary in nature, and other arrangements and patterns of the LEDs may be used.

In some embodiments, the heat spreader 440 may be a heat pipe in that it may be a hollow structure made of a thermally conductive material and containing a fluid at a very low pressure. The heat pipe may be made of a metallic material such as copper or aluminum. The fluid may be any suitable working fluid, such as water, ethanol, or acetone, which may be enclosed in the heat pipe at a partial vacuum. That is, the hollow interior of the heat pipe may be evacuated with only a small fraction of a percent by volume of fluid enclosed. The heat pipe may thereby facilitate heat transfer through both thermal conductivity and phase transition of the fluid.

The device 402 of FIG. 4 may have substantially the same components in the stationary portion 407 as described above with reference to FIG. 3.

In some embodiments, the device 402 may include a waste heat collector to collect and transport heat generated by the LEDs 408, circuitry, and any other components mounted on the rotating portion 403. For example, referring to FIG. 4, a waste heat collector may be implemented by providing a shroud enclosing the outer perimeter region of the fins 418. The shroud may be a cylindrical enclosure which may encompass the region defined by top plate perimeter 446, bottom perimeter 448, and may span the full circumference of the heat transfer structure 404. The waste heat collector may have one or more outlets which are configured to direct the warm air exhausted from the device to a predetermined location. As would be appreciated by those skilled in the art, in some cases, it may be desirable that warm air exhausted from the device is not deposited inside the room where the device is being used, or even within the building envelope. In such cases, the waste heat collector may aid in diverting the heated air to a vent coupled to the building's HVAC system, for example, or for facilitating disposal outside of the building envelope. In other situations, for example in cooler climates, where additional energy is consumed to heat interior spaces of building, depositing the heated air into the room or building may provide an added advantage, and embodiments without a heat collector may be used.

The base 406 of the mounting assembly may include electrical connectors, such that current may be provided to the device from an external source. The base 406 may be configured to fit into conventional light sockets used in various residential, commercial or industrial lighting applications. Electrical current may be provided through the base 406 to the motor 422, the LEDs 408, and the LED driver and other circuitry. Along with providing power, the base 406 can serve to support the lighting device in the desired position. The base 406 may be configured to fit conventional light sockets, such that the lighting device may be coupled to a standard lighting fixture used in various residential, commercial, or industrial applications. The base 406 may be configured to fit a standard Edison screw socket, for example. Other connector configurations may be used, including, but not limited to, a bi-pin connector, or a double-contact bayonet connector, where the bayonet type connector may be particularly suited for limiting loosening of the lighting device from the socket due to vibrations. Other connector types may be used, and other safety mechanisms may be implemented in addition to or in combination with the base configuration selected to limit loosening due to vibration. In various embodiments of screw socket configurations, the direction of rotation of the heat transfer structure may be chosen to provide self-tightening of the screw socket during normal operation.

Other safety devices may be implemented to limit the risk of possible contact with the rotating heat sink impeller 210 of FIG. 2. For example, a mesh screen or some other protective surface may be provided around the heat sink impeller. The mesh screen may be configured to extend around the rotating components, and may enclose the fins 218 and top plate 214 of the heat transfer structure 204, including components mounted to the heat transfer structure, such as the LEDs 208 and circuitry. In the case of a mesh screen, which allows air to flow through it relatively unimpeded, substantially all of the rotating components may be enclosed without loss of functionality (e.g. without affecting the flow of cooling air). If a non-mesh material is used, an inlet and outlet opening may be provided in the surface of the non-mesh material to allow for circulation of air through the heat transfer structure 204. In some embodiments, a protective screen may be provided only around the outer perimeter of the heat sink, in a configuration similar to the waste heat collector structure described above. In other embodiments, which include such a waste heat collector, an additional protective screen may not be needed.

Low frequency vibrations (e.g. wobble) may develop in some examples due to the presence of rotating components. For example, referring to FIG. 3, the primary core 232 and secondary core 230 may wobble with respect to one another during operation. Such vibrations may be effectively detected and the rotation of the device may be disabled or adjusted upon detection of wobble, in some examples. To facilitate detection of wobble or other irregular movement, the lighting device 202 may include a sensor (not shown, but may be positioned, for example, proximate surface 226 of the heat transfer structure or may be incorporated into the transformer assembly 224). The sensor may be configured to detect vibrations and to disable, for example by cutting off power to the motor 222, or adjust rotation of the heat transfer structure 204 upon detecting an unsafe or undesirable operating condition. A vibration sensor may be provided to detect such vibrations and provide a control signal to a motor driver circuit to disable the device 202 until it is reset. In some embodiments, the sensor may be a surface-mount vibration sensor which is operable to detect low frequency vibrations and may be configured to send a disable signal to the motor responsive to the detection of vibrations above a predetermined threshold.

Alternatively, in some embodiments, vibrations may be detectable without the addition of a sensor. For example, some embodiments may be configured to monitor amplitude modulation of the 60 Hz ac waveform generated by the transformer secondary core 230, which may be the result from a periodic variation in the transformer air gap distance. That is, a voltage or current detector may be provided and positioned to monitor the waveform generated by the secondary core 230. In this manner, the variation in the gap distance between the primary and secondary core may facilitate detection of wobble and trigger a shut down or adjustment of the device, permanently, or for a temporary time, or until it is cycled off-on. Furthermore, any asymmetrical features may be arranged in a layout selected towards minimizing rotational imbalance, thereby further reducing likelihood of vibration. That is, in some embodiments having asymmetric arrays of LEDs, or other asymmetric circuit components, sensors, and/or other structural features (e.g. a waste heat collector, for example), such asymmetric components may be configured and arranged in a manner intended to balance rotation. Incorporation of other design features, such as small circuit board cutouts, may also be implemented to trim any residual imbalance to an acceptable level.

Having described examples of devices according to embodiments of the invention, examples of methods will now be discussed in more detail. According to one method for dissipating heat, power may be provided to an electrical device mounted to a heat transfer structure. As generally described above, the electrical device may be in thermal contact with the heat transfer structure, and the heat transfer structure and electrical device together may be rotated through a surrounding medium.

In some embodiments, the electrical device may be a solid state light source, as has been described above with reference to FIGS. 2-4. For example, the electrical device may be one or more LEDs with accompanying driver circuitry. While methods and devices utilizing solid state light sources are described in detail herein, those skilled in the art would appreciate that the electrical device according to embodiments of the invention may include virtually any electrical circuit having surface-mounted components (e.g. surface mount technology (SMT) and surface mount devices (SMD)). By attaching such electrical devices directly to a rotating heat sink, the heat generated by the electrical device (e.g. the thermal load) may be effectively dissipated without substantial interference with the operation of the electrical device or concerns for the structural integrity of the electrical device.

Figure 5:
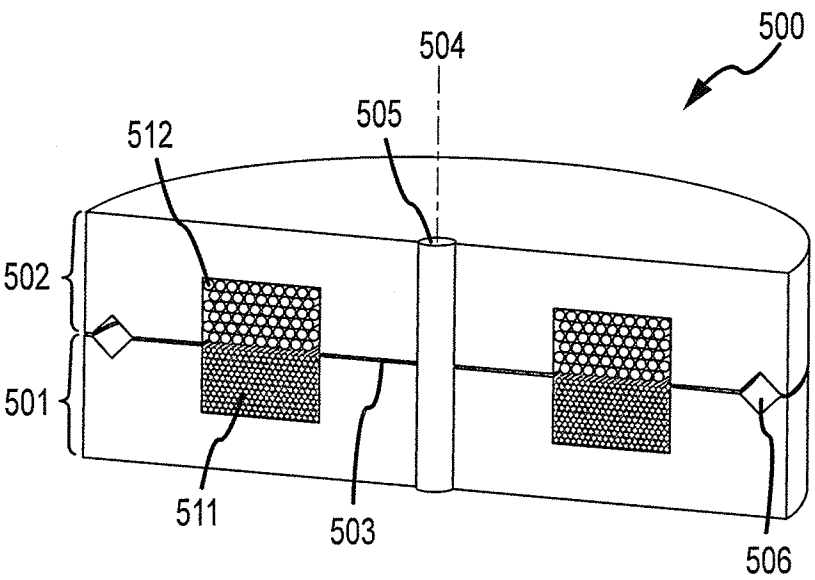
FIG. 5 is a schematic illustration of a cross-sectional schematic view of an example split-core step down transformer according to an embodiment of the present invention.

FIG. 5 is an isometric cutaway view of a split core rotary transformer that may be used to transmit electrical power from the stationary portion 205 of the device to the rotating portion 207 of the device. In some embodiments such a split core rotary transformer may also serve to step down (or step up) the ac voltage used to power the device. As is well known form the prior art, the voltage step down ratio of the transformer may be determined by the ratio $N_1/N_2$, the number of primary windings divided by the number of secondary windings. For example, FIG. 5 depicts a 4-to-1 step-down transformer that may be used to step down a line voltage of 120 Volts AC to 30 Volts AC.

The split core rotary transformer 500 may comprise two core pieces 501 and 502. Core piece 501 and/or core piece 502 may be fabricated from any suitable material having high magnetic permeability. In some examples, the core pieces 501 and 502 may be made of laminated ferrosilicon transformer steel, for example. Other suitable material may of course be used.

In the example depicted in FIG. 5, core piece 501 is associated with the stationary primary winding assembly 511 of the split core rotary transformer. Core piece 502 is associated with the secondary winding assembly 512, which as discussed earlier, is free to rotate along with the heat transfer structure and other electronic components mounted in the rotating frame. As would be appreciated by those skilled in the art, other form factors of the cores pieces and/or windings may be implemented without departing from the scope of the present invention.

Core pieces 501 and 502 may be separated by a narrow air gap 503 to permit their relative movement about the axis of rotation 504. One or more means may be provided to maintain proper spacing and alignment of the two core pieces 501 and 502. In some examples, and as depicted in FIG. 5, a shaft 505 and a roller bearing assembly 506 (rolling elements not shown) may be provided. Such components may also be directed towards maintaining proper mechanical alignment of other components, such as the rotating heat sink impeller, for example.

Primary leads (not shown) may be connected to the primary winding assembly 511 through one or more holes, slots, or perforations in the core piece 501. Similarly, secondary leads (not shown) may be connected to the secondary winding assembly 512 in a similar manner. In some examples, the leads may be routed through a hollow shaft. It would be understood by someone skilled in the art that numerous alternative configurations may be implemented to provide a split core rotary transformer according to embodiments of the present invention. In some examples, a slip ring or other rotary electrical contact entailing direct galvanic contact between the stationary and rotating frame, may be used instead of a split core rotary transformer.

Figure 6:
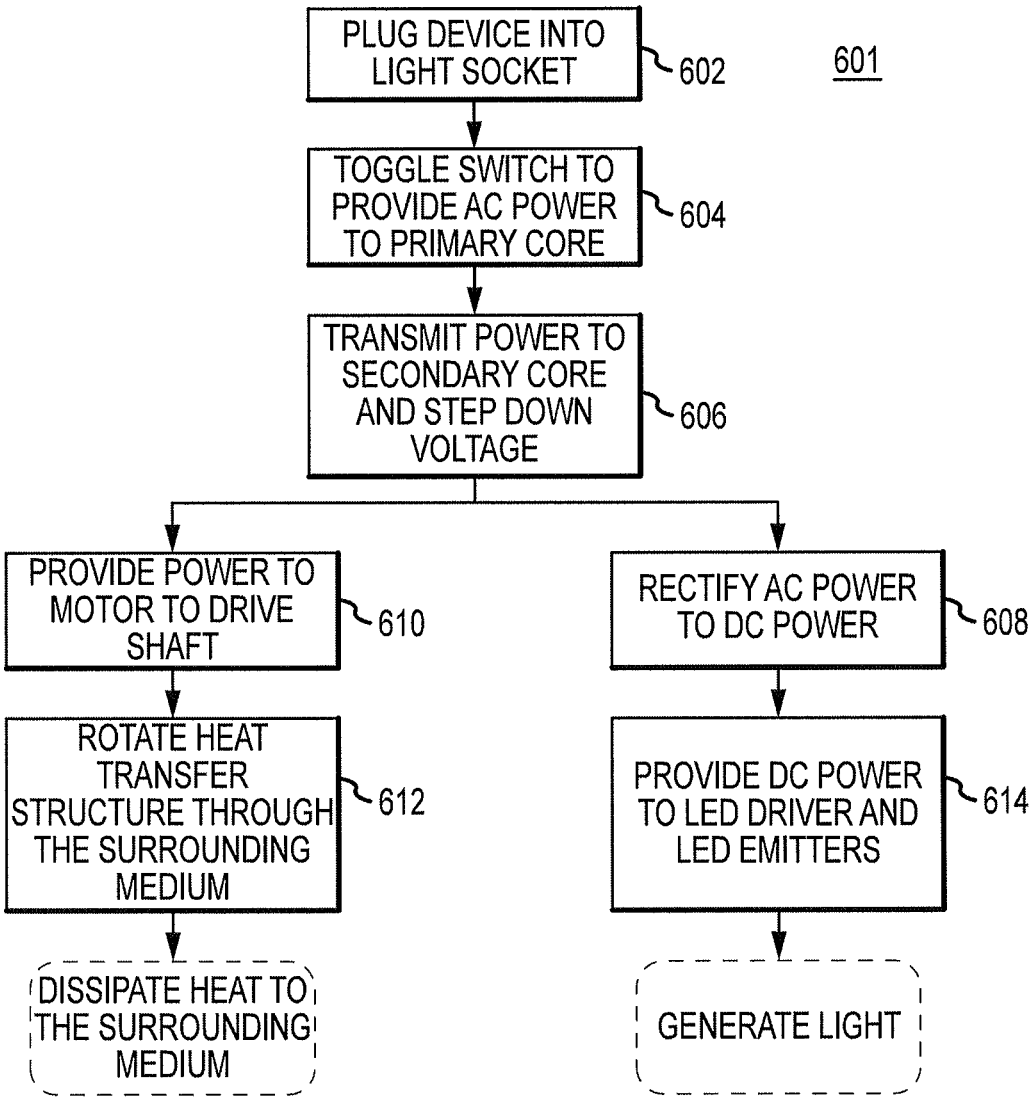
FIG. 6 is a block diagram describing a method of dissipating heat from a lighting device according to an embodiment of the present invention.

FIG. 6 is a block diagram describing a method of dissipating heat from a lighting device according to an embodiment of the present invention. The method 601 according to one embodiment of the invention may include coupling a lighting device having a plurality of LEDs mounted to and in thermal contact with a heat transfer structure to a standard light socket, as shown in step 602. The light socket may be connected to the grid or other external source such that electrical power from the external source may be provided to the LEDs. As shown in step 604, power may be provided to the lighting device by toggling a light switch. As shown in the remaining steps of FIG. 6, during operation, ac power may be delivered from the external source through the stationary portion of the device to the rotating portion of the device.

When ac power is provided to the transformer's primary core, the primary core may generate a magnetic flux through the core. A small gap, which may be approximately ~0.5 mm, may remain between the transformer's primary and secondary cores to allow the secondary core to rotate while the primary core remains stationary. Despite the small gap between the primary and secondary cores, the secondary core is exposed to the flux from the primary core and through inductive coupling between the primary and secondary cores, voltage is provided to the secondary core. The ratio of the number of windings of the primary core and secondary core may be selected to step down the voltage from the external source to the desired voltage for operating the LEDs and circuitry, as shown in step 606. Those skilled in the art would appreciate that in this manner, devices can be configured to operate with any source voltage.

In step 608, power may be provided to a motor which is configured to rotate the rotating heat sink. In the case where an ac motor is used, stepped down ac power from the secondary core can be routed to the motor. In some embodiments, and as shown in 610, the stepped down ac power may be rectified to low voltage dc power and then be provided to power a dc motor.

In step 612, mechanical force generated by the motor may be used to rotate the heat transfer structure on which various electrical components may be mounted, including for example, light sources. The heat transfer structure may be coupled to the stationary portion of the lighting device through a rotary joint which may include one or more bearing assemblies and/or bushings supporting a shaft. The shaft may coaxially align the heat transfer structure, the transformer and the motor, and be configured to transmit mechanical rotational force from the motor. The LEDs and circuitry may be located on the rotating frame of the heat transfer structure, and may be driven by low voltage dc power, as shown in step 514. Some circuitry may also or instead be located on the stationary portion. While light is being generated by the LEDs, heat also generated by the LEDs and other circuitry may be simultaneously dissipated by rotating the heat transfer structure to which the LEDs are mounted through the surrounding medium.

In some examples, the heat transfer structure may be rotated at an angular velocity on the order of 1800 rpm, for example, without raising reliability concerns with respect to the structure. Other rotation speeds may be used. Centrifugal forces acting on a surface mount printed circuit board components and solder joints, which may be rotated at such revolutions may be relatively small and would be substantially constant as a function of time. Thus, such loading may not raise concerns about solder joint fatigue. A metal core printed circuit board (PCB) may be used for purposes of facilitating heat sinking, thus providing additional mechanical stiffness. In embodiments where the LEDs and an annular-shaped PCB are directly mounted to the bottom surface of the rotating heat sink, all electrical routing and connections may be made on the PCB with only two conductors connecting the secondary core of the transformer to the printed circuit board.

Embodiments of the present invention may offer superior thermal management as compared to solid state lighting devices known in the art. As described earlier, one example of a currently available LED bulb for residential/commercial use is the EcoSmart Model ECS38 LED bulb 100 (see FIG. 1), which can consume 18 W of electrical power and can provide a light output of 850 lumens, which is about the equivalent of a 60 W incandescent bulb. The bulb 100 utilizes passive fins, e.g. fin 112 to dissipate heat generated by the light source 120. The total internal power dissipation of the ECS38 bulb may be about 16 W, which can result in a package temperature rise of 23° C. above ambient (measured at the coolest point on the finned aluminum heat sink, which may be at the perimeter 114 of the heat sink which is farthest away from the heat source), corresponding to a heat sink thermal resistance of 1.4° C./W. Devices according to embodiments of the invention may, for example, provide a heat sink thermal resistance of 0.20° C./W, which corresponds to a package temperature rise of 3° C., rather than 23° C. Thus a reduction in LED junction operating temperature of 20° C. can be realized. This may be advantageous with regard to operating lifetime and lifetime-averaged device efficiency. Effective heat sinking of the LED rectification and drive circuitry may provide important benefits, most notably the elimination or reduction of electrolytic capacitor mortality, and improved wall plug efficiency (e.g. minimization of MOSFET drain-source resistance in the LED driver output stages).

Moreover, heat sinking technology according to embodiments of the invention may have indirect impact on consumer acceptance of SSL technology. Consumer prejudice against SSL technology may largely stem from concerns about high upfront costs and low light output. Devices having thermal management technology according to the present invention could reverse this perception. For example, an increased number of emitters can be used with only a slight increase in operating LED junction temperature, thus retaining a longer operating lifetime. Alternatively, the use of fewer emitters operating at higher current, enabled by improved heat sinking methods as described herein, may be used to decrease manufacturing cost. Such improvements in performance may help to further facilitate proliferation and acceptance of SSL technology for general application.

While some embodiments of the present invention may provide advantages described herein or address problems discussed herein, the advantages and problems herein are provided for ease of illustration and understanding, and it is to be understood that some examples of the invention may not provide any or all of the benefits described herein or address any or all of the drawbacks identified in the art.

The devices discussed in detail herein are presented for exemplary purposes only. As would be appreciate by those skilled in the art many other device configurations may be implemented while remaining within the scope of the present disclosure. In addition to downward illuminating, ceiling mounted devices, other devices may also be achieved. Thermal resistances far lower than 0.2 C/W may be realized in a device of larger dimensions, as may be required for applications such as area lighting common in commercial or industrial application, in which high-intensity-discharge metal-halide bulbs generating tens of thousands of lumens are often used.

Turning our attention to other advantages of the rotating heat transfer structures and heat dissipation methods described herein, another embodiment of the invention may substantially eliminate or reduce the reliance on phosphor-converted technology in LED lighting devices. In such an exemplary embodiment, as mentioned above, the lighting device may have colored LEDs. For example, Red, Blue, and Green LEDs may be used. The colored LEDs can be arranged in a circular pattern about the axis of rotation of the heat transfer structure. The colored LEDs can be mounted directly on a surface of the heat transfer structure thereby rotating with the heat transfer structure during operation of the device. In this manner the rotation of the heat transfer structure promotes rotational spatial averaging of the light emitted from the colored LEDs. One of ordinary skill in the art would appreciate that the resulting additive color mixing would facilitate generation of white light.

Additive color mixing of currently available red, green and blue LEDs may be capable of providing a CRI value of 92 at a luminous efficacy of 173 lm/W, which can be greater than a factor of three higher than the luminous efficacy of the ECS38 LED bulb (47 lm/W) discussed earlier and illustrated in FIG. 1. Moreover, even higher CRI values may be obtained by mixing of four or more different LED colors. However, despite the potential advantages of using additive color mixing, available LED lighting devices remain dominated by phosphor-converted LEDs. This may be in large part due to technical difficulties with implementing additive color mixing successfully. For example, adequate spatial color mixing from a stationary closely situated array of different colored LEDs (such that illuminated objects do not appear splotchy, cast colored shadows, etc.) has proven problematic. The required optics may be bulky, and suffer from significant loss of useful light output (e.g. optically thick diffusers), or poor color mixing (e.g. transparent acrylic light pipes). This has been a significant deterrent to the adoption of RGB illumination technology.

In principle, perfect color mixing can be achieved by configuring separate red, green, and blue emitters of equal emitter size, having identical angular luminance distributions, such that all emitters occupy the exact same location. As would be apparent to one of ordinary skill, the latter requirement (e.g. multiple emitters occupying the same location) is physically impossible. The first two requirements, related to the spatial distribution of light generated by each emitter, can be met with sufficient accuracy because LED die size and the geometry of the encapsulation package and integral lens are engineering parameters under our control. The third requirement for nominally ideal or improved additive color mixing may be realized by rotational spatial averaging, described herein, even with a sparse array of emitters.

As an example of an embodiment which may offer the above advantages, a 12-emitter, circular, LED array may be configured according to an embodiment of the invention, where the array can have a repeating pattern of red, green and blue LEDs (R-G-B-R-G-B-R-G-B-R-G-B), and wherein color mixing can be provided by rotational spatial averaging at 1800 rpm, for example. Such a color mixing scheme may be an extremely effective method of achieving a uniform white light distribution while removing the need for optics. While the angular period of the R-G-B array (90°) and the angular velocity of the heat-sink-impeller (30 Hz) may generate flicker with a fundamental frequency of 120 Hz, such flicker is already generated by conventional fluorescent bulbs. To minimize the possibility of low-frequency flicker due to interaction of overlapping illumination distributions between adjacent RGB LED fixtures, and/or nearby fluorescent lights, a synchronous 1800 rpm motor may be used. Such implementation may be achieved by using a synchronous ac motor, or a brushless dc motor whose excitation waveform is phase-locked to the nominally 60-Hz line frequency waveform. As would be appreciated by those skilled in the art, the electronics required to implement the latter arrangement may be inexpensive to implement. Additional electronic functionality such as rotor synchronization and color balance temperature compensation may be incorporated by methods known in the art into a single dedicated integrated circuit, which may (aside from a small number of passive components) incorporate all of the LED rectification/regulation circuitry as well.

Solid state lighting devices according to embodiments of the invention may be a practical implementation of a technology described herein, which may drastically reduce electrical power consumption. The air-cooled heat exchanger technology in configurations in accordance with the present invention may provide the necessary thermal management solution to resolve problems that have plagued solid state lighting technology. Another benefit of the invention disclosed herein is the ability to limit solid state lighting technology dependency on phosphor-based LEDs and thus eliminate the intrinsic inefficiency (and relatively low CRI) currently imposed by phosphor-converted LED technology.

Thermal management examples described herein and air-cooled heat exchanger technology described in co-pending application U.S. Publication No. 2009/0199997, which is incorporated herein by reference, can be implemented for thermal management of solid state lighting devices and may achieve a package thermal resistance of approximately 0.2 C/W. Further advantages of the present design is to provide a nearly inaudible operation as compared to conventional high-volumetric-flow-rate fans, as well as providing a package that may be substantially immune to fouling by dust due to the rotating finned heat exchanger arrangement.

The hybrid architecture of a combining a finned heat sink with an impeller may provide a far more effective physical mechanism for air cooling than currently available methods. This architecture may provide advantageous high volumetric flow rates with low fan noise. As has been demonstrated in testing, the inertial forces in the rotating frame alter the flow field around the finned heat sink resulting in a thinner boundary layer and thus higher rates of heat transfer. Furthermore, when rotating at several thousand rpm, the surface of the heat transfer structure can remain substantially free of dust therefore limiting or eliminating the fouling problem which results in degradation of heat sink performance.

While devices appropriate for conventional residential use have generally been described herein, scaling and applicability to other solid state lighting devices may be realized. Multiple design parameters may be modified and optimized for the desired application. For example, some design parameters that which may be tailored for different needs and uses include, fin height, fin sweep angle, fin solidity, fin inner diameter, fin outer diameter, sweep functional form, air channel width, air channel entrance angle, air channel exit angle, and angular velocity.

Examples described herein may offer bright and extremely efficient solid state lighting devices that are compact, silent, and provide excellent CRI, with operating lifetimes well in excess of that required to offset their initial cost may be obtained. Furthermore, dependency on phosphor-converted technology may be limited or eliminated. Placing the LED emitters and associated electronics in a rotating frame according to embodiments of the invention described herein may provide substantial advances towards solving a long-standing thermal management problem with solid state lighting devices. This combined with the further benefit of taking advantage or rotational spatial averaging of colored LEDs may further improve LED bulbs' efficiency by delivering high CRI white lighting without reliance on the inefficient phosphor-converted technology.

Devices configured according to embodiments of the invention disclosed herein, in which heat transfer occurs in a rotating frame of reference, may simultaneously confer advantages such as: (1) placing the boundary layer in an accelerating frame of reference may make it possible to exploit a little known inertial fluid dynamic effect that drastically reduces the thermal resistance of the heat sink boundary layer, and in a manner that is not energy intensive, (2) elimination of the heat exchanger fan in favor of an architecture that directly generates the desired relative motion between the finned heat sink and the surrounding air may address the problem of low aerodynamic efficiency, and cooling performance limitations imposed by fan noise, and (3) such a finned heat exchanger rotating at high angular velocity may not accumulate significant quantities of dust and other foreign matter.

From the foregoing it will be appreciated that, although specific embodiments of the invention have been described herein for purposes of illustration, it will be understood by those skilled in the art that various modifications may be made without deviating from the spirit and scope of the invention. Accordingly, the invention is not limited except as by the appended claim.

What is claimed is:

1. A solid state lighting device comprising:

a solid state light source;

a heat transfer structure mechanically and thermally coupled to the solid state light source, the heat transfer structure configured to rotate with the solid state light source about an axis of rotation of the heat transfer structure when electrical power is provided to the device, wherein the heat transfer structure comprises a first plate centered at the axis of rotation, the first plate having a planar surface and a plurality of fins attached to the planar surface along a peripheral portion of the first plate, wherein the heat transfer structure is configured to transfer heat from the solid state light source by conduction; and a mounting assembly rotatably coupled to the heat transfer structure and having a stationary portion, wherein the stationary portion is configured to remain stationary with respect to the heat transfer structure when electrical power is provided to the device.

2. The device of claim 1, wherein the plurality of fins form an inlet region about the axis of rotation of the heat transfer structure, wherein the inlet region is substantially free of fins.

3. The device of claim 1, wherein the first plate and the plurality of fins are a unitary structure.

4. The device of claim 1, wherein the heat transfer structure further comprises a second plate attached to the plurality of fins opposite the first plate, the second plate having an annular shape.

5. The device of claim 4, wherein the solid state light source is mounted on the planar surface, on the second plate, or a combination thereof.

6. The device of claim 4 wherein the second plate comprises a heat pipe.

7. The device of claim 1, wherein the heat transfer structure promotes radial flow of a surrounding medium through the heat transfer structure when the heat transfer structure is rotated about the axis of rotation.

8. The device of claim 1 wherein the heat transfer structure comprises a rotating heat sink impeller.

9. The device of claim 1, wherein the solid state light source is mounted on the planar surface.

10. The device of claim 1 wherein the solid state light source is mounted on a third surface proximate the heat transfer structure, wherein the third surface remains stationary during operation of the device.

11. The device of claim 1, wherein the solid state light source comprises one or more light emitting diodes (LEDs) and wherein the one or more LEDs comprise colored LEDs arranged radially about the axis of rotation and configured to rotate about the axis of rotation during operation of the device, thereby promoting color mixing of light emitted from the colored LEDs to generate white light.

12. The device of claim 1 further comprising a motor coupled to the heat transfer structure and configured to rotate the heat transfer structure.

13. The device of claim 12, further comprising a surface-mount vibration sensor operable to detect low frequency vibrations and configured to send a disable signal to the motor.

14. The device of claim 1 further comprising a transformer having a primary core in the stationary portion of the mounting assembly and a secondary core coupled to the heat transfer structure and configured to rotate with the heat transfer structure.

15. The device of claim 1 wherein the mounting assembly is further configured to provide electrical current from an external source to the solid state light source and the motor.

16. The device of claim 1 further comprising a base for coupling the device to a conventional light fixture.

17. The device of claim 1 further comprising a waste heat diversion structure configured to collect and exhaust waste heat from the surrounding medium to a waste heat vent.

18. A method of dissipating heat from an electrical device, the method comprising:

providing electrical power to an electrical device comprising a solid state light source, the electrical device mounted to a thermally conductive heat transfer structure, the thermally conductive heat transfer structure comprising a plate having a planar surface and a plurality of fins coupled to the planar surface, wherein the electrical device is in thermal contact with the conductive heat transfer structure and positioned in an inlet region of the thermally conductive heat transfer structure; and rotating the thermally conductive heat transfer structure and the electrical device together at least 360 degrees through a surrounding medium while providing electrical power to the electrical device to cause air to flow into the inlet region to cool the electrical device and exit radially outward through the fins of the thermally conductive heat transfer structure.

19. The method of claim 18, wherein said providing electrical power further comprises sourcing ac power from the grid and providing said source ac power to a split-core transformer.

20. The method of claim 19, wherein rotating the thermally conductive heat transfer structure comprises providing electrical power to a motor configured to rotate the thermally conductive heat transfer structure.

21. A method of producing white light using colored light emitting diodes (LEDs), comprising:

providing electrical power to an electrical device having a plurality of colored LEDs mounted on a first surface of a finned heat transfer structure, wherein the finned heat transfer structure is configured to conductively transfer heat and is further configured to rotate about an axis of rotation passing through a center of the finned heat transfer structure, wherein the LEDs are arranged in a circular pattern about the axis of rotation, and wherein the LEDs are in thermal contact with the heat transfer structure;

rotating the heat transfer structure about the axis of rotation such that the LEDs rotate with the heat transfer structure, thereby promoting color mixing of light emitted from the LEDs; and producing white light.

22. A solid state lighting device comprising:

a solid state light source;

a heat transfer structure in thermal contact with the solid state light source, wherein the heat transfer structure comprises a conductive heat sink, the heat transfer structure configured to rotate through a surrounding medium during operation of the device; and a mounting assembly rotatably coupled to the heat transfer structure and having a stationary portion, wherein the stationary portion is configured to remain stationary with respect to the heat transfer structure during operation of the device, wherein the solid state light source comprises one or more light emitting diodes (LEDs) and an LED driver circuit, and wherein the one or more LEDs comprise colored LEDs arranged radially about the axis of rotation and configured to rotate about the axis of rotation during operation of the device, thereby promoting color mixing of light emitted from the colored LEDs to generate white light.

23. A solid state lighting device comprising:

a solid state light source;

a heat transfer structure in thermal contact with the solid state light source, the heat transfer structure configured to rotate through a surrounding medium during operation of the device;

a mounting assembly rotatably coupled to the heat transfer structure and having a stationary portion, wherein the stationary portion is configured to remain stationary with respect to the heat transfer structure during operation of the device;

a motor coupled to the heat transfer structure and configured to rotate the heat transfer structure; and a surface-mount vibration sensor operable to detect low frequency vibrations and configured to send a disable signal to the motor.

* * * * *